United States Patent [19]

Wiesner

[11] 4,245,335

[45] Jan. 13, 1981

[54] WATCH DISPLAY

[75] Inventor: Leo Wiesner, Kew Gardens, N.Y.

[73] Assignee: Timex Corporation, Middlebury, Conn.

[21] Appl. No.: 79,733

[22] Filed: Sep. 28, 1979

[51] Int. Cl.[3] ..... G04C 17/00; G04C 19/00

[52] U.S. Cl. ..... 368/70; 368/82; 368/239

[58] Field of Search ..... 58/21.13, 38 R, 38 A, 58/39.5, 152 R, 152 B, 145 K, 145 D; 340/323; 235/92 T, 92 TA; 364/705; 368/69–70, 82–84, 239–242

[56] References Cited

U.S. PATENT DOCUMENTS 3,980,868 9/1976 Thompson ..... 58/39.5

*Primary Examiner*—Vit W. Miska

[57] ABSTRACT

A digital timepiece is provided with a quartz oscillator, frequency divider and counting circuits, a decoder and a digital electrooptical display device. The timepiece is suitable to operate as a standard digital wristwatch to display the present, i.e., elapsed, time or in the alternative to indicate the remaining time of minutes in the hour or remaining seconds of the minute, i.e., the complement of the elapsed time. A data converter circuit responsive to a manually actuatable switch device is provided for performing the data complement conversion function.

6 Claims, 2 Drawing Figures

WATCH DISPLAY

FIELD OF THE INVENTION

This invention relates to a digital wristwatch for displaying elapsed and remaining time information within a predetermined time period.

BACKGROUND OF THE INVENTION

While digital wristwatches having timekeeping displays have taken on various forms, such wristwatches have been found to have various defects during normal operation. Particularly, digital wristwatches display present or elapsed time, for example 2:23, i.e. twenty three minutes after two o'clock, but they do not present the time remaining within the hour, i.e. 37 minutes.

Prior art patents of interest include U.S. Pat. Nos. 3,950,935 issued Apr. 20, 1976 to Okito Naito; 3,822,547 issued July 9, 1974 to Kinji Fujita; 3,950,936 issued Apr. 20, 1976 to Henri J. Oguey et al; and 3,971,205 issued July 27, 1976 to Yasushi Nomura et al.

OBJECTS OF THE INVENTION

An object of the invention is to provide a digital wristwatch which obviates the above mentioned disadvantages of the prior art timepieces to display the remaining time within a predetermined period.

Another object of the invention is to provide a digital display wristwatch which displays the time in hours and minutes and selectively can display the minutes remaining in the hour.

A further object of the invention is to provide a digital wristwatch which can display the operating condition of the minutes or seconds time counter and selectively can display the data complement of the operating condition of the minutes or seconds time counter.

Still a further object of the invention is to provide an all electronic timepiece which can present time information in digital format such as 2:23, i.e. twenty three minutes after two o'clock, and on demand of the operator can present the minutes, e.g. 37, remaining until the next hour such as 3:00.

These and other objectives and features of the present invention will be apparent from the description of a preferred embodiment of the invention, taken in conjunction with the accompanying drawings.

DESCRIPTION OF THE PREFERRED EMBODIMENT

Figure 1:
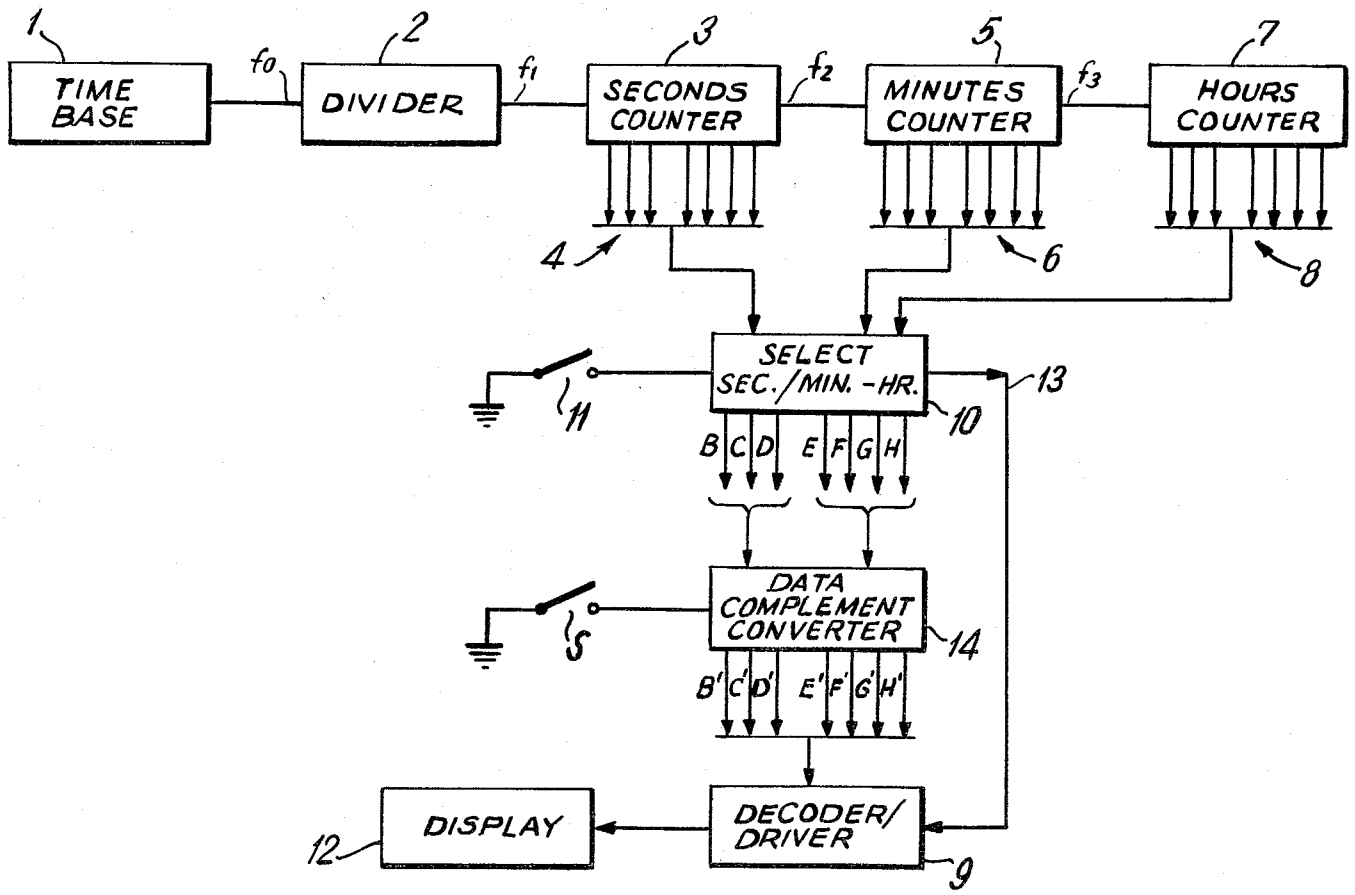
FIG. 1 is a block diagram of an electronic timepiece according to the invention.

FIG. 1 shows a block diagram of a digital watch with an electrooptical display 10. The watch comprises a time base 1 of a known type, for example, a quartz crystal-controlled oscillator as shown in U.S. Pat. No. 4,117,421 issued Sept. 26, 1978 to Leo Wiesner. The time base 1 is connected to a divider 2, of known type including a certain number of binary stages in cascade, so as to provide an output signal $f_1$, of 1HZ for example.

The output signal $f_1$ of divider 2 is supplied to a seconds counter 3, also of a known type, which provides several outputs 4 indicative of the count of seconds and a sixty seconds or one minute count $f_2$. The one minute count $f_2$ is supplied to a minutes counter 5 of known type.

The minutes counter 5 provides several outputs 6 indicative of the count of minute pulses $f_2$ and a count of sixty minutes or one hour pulse $f_3$. The one hour pulse $f_3$ is supplied to an hours counter 7 of known type.

The hours counter 7 provides several outputs 8 indicative of the count of hours to a select seconds/minutes-hours circuit 10 of known type.

The seconds and minutes output counts 4, 6 of the seconds counter 3 and minutes counter 5, respectively, are supplied to the select seconds/minutes-hours circuit 10.

Briefly, the select seconds/minutes-hours circuit 10 is a signal selection means which typically functions to selectively supply, responsive to switch 11, either the seconds output counter signals 4 or the minutes and hours output counter signals 6, 8 to the decoder-driver circuit 9. The elapsed time count comprising either the seconds count signal 4 or the minutes count signal 6, depending upon position of selector switch 11, is supplied as binary coded decimal (BCD) output data signals B-H to the data complement converter 14 which, in turn, supplies decoder-driver circuit 9. Outputs B, C and D give the "units" count and outputs E, F, G, H give the "tens" count. The hours count signal 8 is supplied directly to the decoder-driver as output signal 13 without passing through converter 14. Switch 11 typically is controlled by manual actuation of a push-button actuator (not shown).

In the normally open position of switch 11, the minutes and hours count signals 6,8 are supplied, via outputs B'-H' and 13 respectively, to the decoder-driver circuit 9 and the time in hours and elapsed minutes in the hour are shown on display 12. Depression of the push-button and, thereby closure of switch 11 causes the hours and minutes to be extinguished and the seconds to be displayed on display 12.

Figure 2:
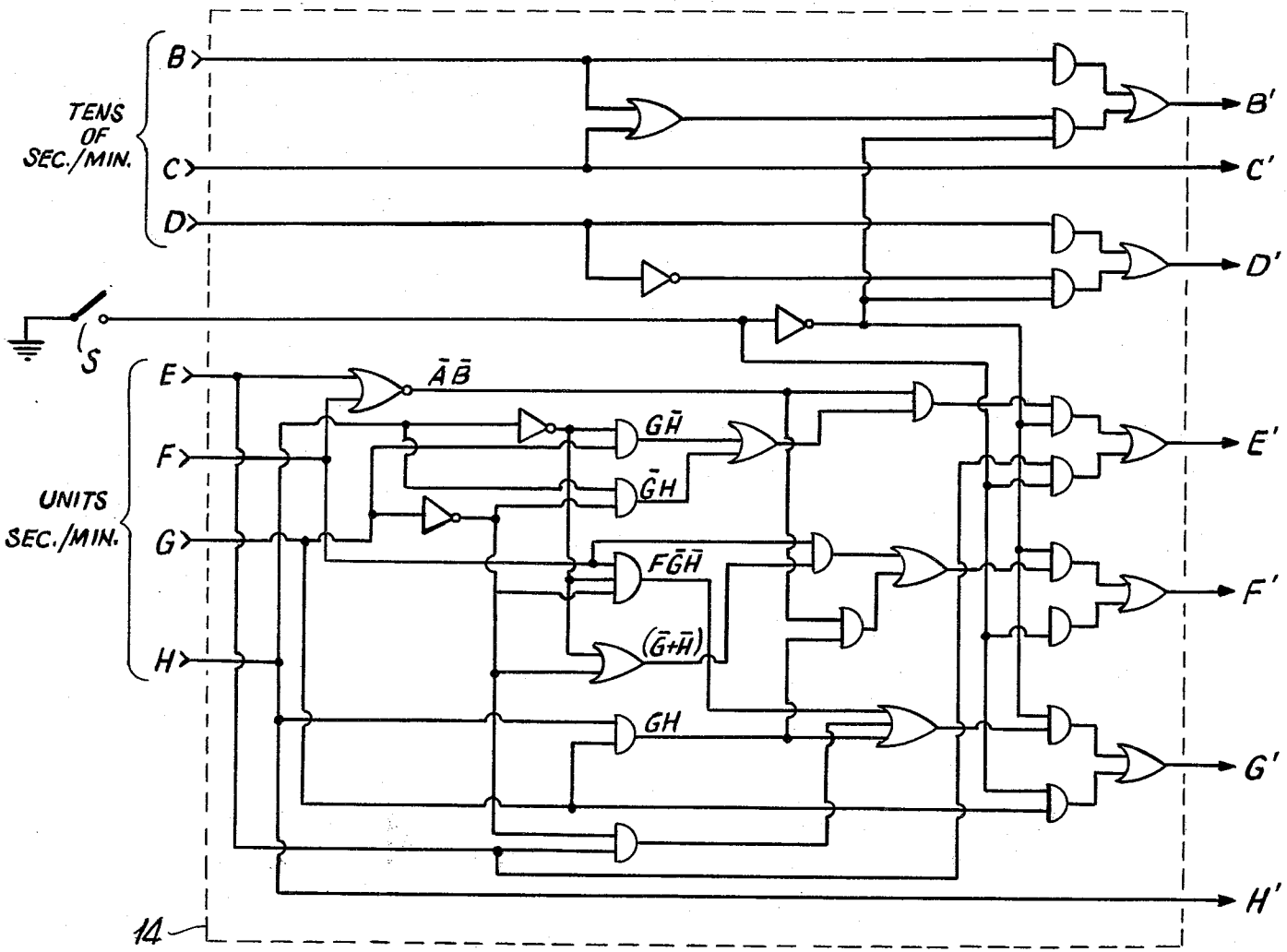
FIG. 2 is a logic circuit diagram of the Data Converter in accordance with the invention.

In accordance with the invention, several outputs B through H of the select seconds/minutes-hours circuit 10 representing seconds count or minutes count (elapsed timed count) are supplied to a data complement converter 14. The details of the circuitry of the data complement converter 14 are shown in FIG. 2. Briefly, the data complement converter 14 functions to selectively supply, responsive to switch S, either the data on outputs B through H supplied by the select seconds/minutes-hours circuit 10 or the complement thereof. In other words, the data complement converter 14 functions such that if switch S is open, i.e., not actuated, the binary coded decimal (BCD) information supplied via outputs B through H, e.g. representing either the output count of the seconds or minutes counters 3,5 dependent on the position of switch 11, is coupled via outputs B' through H' to the decoder-driver 9 whereby the elapsed (or present) time is shown on the display 12. With switch S closed, the complement of the binary coded decimal information being supplied via outputs B through H is provided an outputs B' through H'. Thus, with switches 11 and S open (not actuated), the time in hours and elapsed minutes in the hour, for example 2:23, displayed. With switch 11 open and switch S closed (actuated), the time in hours and remaining minutes in the hour, for example 2:37, or alternatively only the remaining minutes, i.e., 0:37 (typically referred to as thirty seven minutes to three o'clock) is displayed. With switch 11 closed and switch S open, the elapsed seconds in the minute, for example 45, are displayed. With switches 11 and S closed, the remaining seconds in the minute, for example 15, are displayed. In this manner, the operator of the watch is given the option to perceive time in the present (elapsed) format and/or in the future or remaining format.

FIG. 2 shows a detailed circuit drawing of the data complement converter 14. The following Boolean Algebraic expressions in Table 1 describe the normal/-complementary selection and complementary conversion functions performed by the data complement converter 14.

TABLE 1

| Units: Minutes or Seconds | Tens: Minutes or Seconds |
|---|---|
| $E' = \bar{S}E + S[E\bar{F}(G\bar{H} + \bar{G}H)]$ | $A' = 0$ |
| $F' = \bar{S}F + S[F(\bar{G} + \bar{H}) + \bar{E}\bar{F}GH]$ | $B' = \bar{S}B + S\bar{B}\bar{C}$ |
| $G' = \bar{S}G + S[GH + E\bar{G} + F\bar{G}\bar{H}]$ | $C' = C$ |
| $H' = H$ | $D' = \bar{S}D + S\bar{D}$ |

Table 2 shows the truth table for the logic circuit illustrated in FIG. 2

TABLE 2

| UNITS: MINUTES/SECONDS | | | | | COMPLEMENT UNITS: MINUTES/SECONDS | | | | |
|---|---|---|---|---|---|---|---|---|---|
| DIGIT | E' | F' | G' | H' | DIGIT | E' | F' | G' | H' |
| 0 | 0 | 0 | 0 | 0 | 0 | 0 | 0 | 0 | 0 |
| 1 | 0 | 0 | 0 | 1 | 9 | 1 | 0 | 0 | 1 |
| 2 | 0 | 0 | 1 | 0 | 8 | 1 | 0 | 0 | 0 |
| 3 | 0 | 0 | 1 | 1 | 7 | 0 | 1 | 1 | 1 |
| 4 | 0 | 1 | 0 | 0 | 6 | 0 | 1 | 1 | 0 |
| 5 | 0 | 1 | 0 | 1 | 5 | 0 | 1 | 0 | 1 |
| 6 | 0 | 1 | 1 | 0 | 4 | 0 | 1 | 0 | 0 |
| 7 | 0 | 1 | 1 | 1 | 3 | 0 | 0 | 1 | 1 |
| 8 | 1 | 0 | 0 | 0 | 2 | 0 | 0 | 1 | 0 |
| 9 | 1 | 0 | 0 | 1 | 1 | 0 | 0 | 0 | 1 |

| TENS: MINUTES/SECONDS | | | | COMPLEMENT TENS: MINUTES/SECONDS | | | |
|---|---|---|---|---|---|---|---|
| DIGIT | B' | C' | D' | DIGIT | B' | C' | D' |
| 0 | 0 | 0 | 0 | 5 | 1 | 0 | 1 |
| 1 | 0 | 0 | 1 | 4 | 1 | 0 | 0 |
| 2 | 0 | 1 | 0 | 3 | 0 | 1 | 1 |
| 3 | 0 | 1 | 1 | 2 | 0 | 1 | 0 |
| 4 | 1 | 0 | 0 | 1 | 0 | 0 | 1 |
| 5 | 1 | 0 | 1 | 0 | 0 | 0 | 0 |

I claim:

1. A digital wristwatch having a manually operable control switch comprising:

a quartz oscillator means for generating a relatively high frequency time standard signal;

divider means responsive to the time standard signal to produce low frequency timekeeping signals;

counting circuit means responsive to the timekeeping signals adapted to count specific units of time and provide at least a binary coded elapsed minutes signal and an hours signal representative of the present time;

data complement converter means responsive to said elapsed minutes signal and responsive to said manually operable control switch to selectively provide either the elapsed minutes signal for a remaining minutes signal representative of the minutes remaining until the end of the present time hour signal, said converter means comprising a logic circuit providing a binary coded signal corresponding to remaining minutes for each of said binary coded elapsed minute signals; and electrooptical digital display means responsive to the elapsed minutes and hours signal to display the present time and responsive to the remaining minutes signal to display the minutes remaining in the hour of the present time.

2. A digital wristwatch as in claim 1, having a manually operable select switch wherein:

the counting means provides a binary coded elapsed seconds signal representative of the elapsed seconds of the minute of the present time;

the logic circuit of said data complement converter means in response to the manually operable control switch selectively provides either the binary coded elapsed seconds signal or a binary coded seconds remaining signal representative of the seconds remaining until the end of the minute signal of the present time; and signal selection means coupled between the counting means and the converter means and responsive to said select switch to provide either the elapsed minutes signal or the elapsed seconds signal to the converter means.

3. A digital wristwatch as in claim 2 wherein:

the counting circuit means includes at least three binary counters.

4. A digital timepiece having a manually operable select switch and a manually operable control switch comprising:

a quartz oscillator means for generating a relatively high frequency time standard signal;

divider means responsive to the time standard signal to produce a low frequency timekeeping signal;

counting means responsive to the timekeeping signals for providing seconds, minutes and hours signals representative of the present time;

a signal selection means coupled to the seconds, minutes and hours signals and responsive to said manually operable select switch to selectively provide either the seconds signal or the minutes hours signals;

data converter means coupled to the signal selection means and responsive to said manually operable control switch to selectively provide either the seconds signal or a complement seconds signal representative of the seconds till the next successive minutes signal, or to provide either the minutes signal or a complement minutes signal representative of the minutes till the next successive hours signal; and digital display means responsive to the minutes and hours signal to display the present time, responsive to the complement minutes signal to display the minutes count until the next successive hours signal, responsive to the seconds signal to display the elapsed seconds of the minutes of present time and responsive to the complement seconds signal to display the seconds count till the next successive minutes signal.

5. A digital timepiece as in claim 4, wherein:

the counting means includes at least three binary counters for producing binary coded decimal signals representative of the seconds, minutes and hours signals;

the digital display means includes a decoder and display driver circuit; and the complement seconds signal comprises the binary coded decimal seconds signal corresponding to the remaining seconds and the complement minutes signal comprises the binary coded decimal minutes signal corresponding to the remaining minutes.

6. A digital timepiece having a manually operable select switch and a manually operable control switch and comprising in combination:

a quartz oscillator means for generating a relatively high frequency time standard signal;

divider means responsive to the time standard signal to produce a low frequency timekeeping signal;

counting means including binary counter circuits responsive to the timekeeping signal for producing a binary coded decimal seconds, minutes and hours signals representative of the present time;

signal selection means coupled to the seconds, minutes and hours signals and responsive to said manually operable select switch to selectively provide either the seconds signals or the minutes and hours signal;

converter means coupled to the signal selection means being responsive to said manually operable control switch and to the selected output of the signal selection means to selectively provide either the seconds signal or a complement seconds signal representative of the seconds remaining in the minute of the present time or to provide either the minutes signals or a complement minutes signal representative of the minutes remaining in the hour of the present time; and decoder-driver digital display means responsive to the seconds or minutes signal to display either the seconds or minutes and hours of the present time and responsive to the complement seconds or minutes signal to display either the seconds remaining in the minute of the present time or the minutes remaining in the hour of the present time.

* * * * *